US006508253B2

(12) United States Patent
Okumoto et al.

(10) Patent No.: US 6,508,253 B2
(45) Date of Patent: Jan. 21, 2003

(54) BELT-TYPE COMPRESSION MOLDING APPARATUS FOR A TOBACCO STREAM

(75) Inventors: Yutaka Okumoto, Tokyo (JP); Hisao Suzuki, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 153 days.

(21) Appl. No.: 09/776,776

(22) Filed: Feb. 6, 2001

(65) Prior Publication Data

US 2001/0003987 A1 Jun. 21, 2001

Related U.S. Application Data

(63) Continuation of application No. PCT/JP99/04272, filed on Aug. 6, 1999.

(30) Foreign Application Priority Data

Aug. 6, 1998 (JP) ..... 10-223060

(51) Int. Cl.[7] ..... A24C 5/18

(52) U.S. Cl. ..... 131/84.1; 131/84.2; 131/84.4; 131/84.3

(58) Field of Search ..... 131/84.1, 84.2, 131/84.4, 84.3

(56) References Cited

U.S. PATENT DOCUMENTS

| | | | | |
|---|---|---|---|---|
| 3,716,443 A | | 2/1973 | Preston | |
| 5,810,016 A | * | 9/1998 | Okumoto et al. | 131/84.1 |

FOREIGN PATENT DOCUMENTS

| | | |
|---|---|---|
| EP | 0879564 | 11/1998 |
| JP | 48-24757 | 7/1973 |
| JP | 5-130857 | 5/1993 |
| JP | 11-69964 | 3/1999 |

* cited by examiner

*Primary Examiner*—Steven P. Griffin
*Assistant Examiner*—Dionne A. Walls
(74) *Attorney, Agent, or Firm*—Birch, Stewart, Kolasch & Birch, LLP

(57) ABSTRACT

A belt-type compression molding apparatus for a tobacco stream includes a compression belt integral with a tobacco band for forming the tobacco stream, and the compression belt extends from the tobacco band toward a wrapping section of a cigarette manufacturing machine. The compression belt defines a compression molding passage for the tobacco stream in cooperation with a molding groove of a molding bed for guiding wrapping paper. The compression belt travels at the same speed as the tobacco band and serves as a movable ceiling wall of the compression molding passage.

13 Claims, 3 Drawing Sheets

BELT-TYPE COMPRESSION MOLDING APPARATUS FOR A TOBACCO STREAM

This application is a Continuation of PCT International Application No. PCT/JP99/04272 filed on Aug. 6, 1999, which designated the United States, and on which priority is claimed under 35 U.S.C. §120, the entire contents of which are hereby incorporated by reference.

TECHNICAL FIELD

The present invention relates to a belt-type compression molding apparatus for compression molding a tobacco stream inside a cigarette manufacturing machine into a predetermined shape, the compression molded tobacco stream being delivered from the compression molding apparatus to a wrapping section of the cigarette manufacturing machine.

BACKGROUND ART

A cigarette manufacturing machine has an endless tobacco band for sucking a layer of shredded tobacco thereon to form a tobacco stream, and a wrapping section for continuously wrapping the tobacco stream in wrapping paper. A compression molding apparatus used in this type of cigarette manufacturing machine is arranged between the tobacco band and the wrapping section and includes a shoe and a tongue. The shoe and the tongue define a compression molding passage connecting between the tobacco band and the wrapping section. The shoe is located adjacently to the tobacco band and peels the tobacco stream from. the tobacco band to be introduced into the compression molding passage. As the tobacco stream passes through the compression molding passage, the tongue compresses, with its lower surface, the tobacco stream from above, thereby molding the tobacco stream into a predetermined shape corresponding to the shape of the lower surface thereof. This process of compressing and molding the tobacco stream is important in order to ensure smooth wrapping of the tobacco stream in the wrapping paper in the subsequent wrapping section as well as stable formation of a tobacco rod.

The shoe and the tongue are both fixed members. Accordingly, when the tobacco stream passes through the compression molding passage, the shoe and the tongue constitute large resistance to smooth passage of the tobacco stream. Such resistance increases with increase in the speed of the tobacco stream and possibly causes fragmentation of the shredded tobacco in the tobacco stream. Also, as the resistance increases, the temperature of the shoe and the tongue rises due to frictional heat, with the result that the tobacco stream is overheated.

The tobacco rod has the shredded tobacco filled therein, and if the shredded tobacco is shattered or fragmented as mentioned above, a hard spot where the shredded tobacco is closely filled and a soft spot where the shredded tobacco is loosely filled are produced irregularly along the tobacco rod. Thus, when the tobacco rod is cut to cigarette rods of predetermined length in a cutting section of the cigarette manufacturing machine, a soft spot may be situated at the cut end of a cigarette rod. If this occurs, since the filling density of the shredded tobacco is low at the cut end, the shredded tobacco in the cigarette rod is liable to drop from the cut end.

Also, overheating of the tobacco stream results in heat deterioration of the shredded tobacco, spoiling the original taste and flavor of the shredded tobacco.

An object of the present invention is therefore to provide a belt-type compression molding apparatus for a tobacco stream which can prevent the shredded tobacco in the tobacco stream from being fragmented or overheated and yet permits increase in the speed of the tobacco stream, thereby improving the productivity of the tobacco rod.

DISCLOSURE OF THE INVENTION

The above object is achieved by the present invention, and a belt-type compression molding apparatus according to the present invention comprises a compression belt which is formed by part of an extension of a tobacco band, the compression belt defining a compression molding passage for a tobacco stream on one side thereof. The compression molding apparatus further comprises a guide support for supporting the opposite side of the compression belt over an entire area of the compression molding passage, and the guide support includes a guide groove. The guide groove guides travel of the compression belt and also causes the compression belt to be curved in a manner such that the cross-sectional form of the compression belt gradually changes from a flat shape at an inlet of the compression molding passage to an arcuate shape at an outlet of the same.

In the above compression molding apparatus, the tobacco stream is formed by being drawn onto the tobacco band by suction, and as the tobacco band travels, the tobacco stream is conveyed toward a wrapping section of a cigarette manufacturing machine. After reaching the compression band, the tobacco stream is then conveyed along with the running of the compression band. As the compression band advances from the inlet toward the outlet of the compression molding passage, the compression band is gradually curved by the guide groove of the guide support such that the cross-sectional form thereof changes from a flat shape to an arcuate shape. Consequently, the tobacco stream introduced into the compression molding passage together with the compression band is molded into a predetermined shape while being compressed by the compression band. Since the compression band travels with the tobacco stream, it never constitutes resistance to the conveyance of the tobacco stream. Accordingly, even if the speed of conveyance of the tobacco stream is increased, overheating or fragmentation of the shredded tobacco in the tobacco stream can be significantly reduced, making it possible to manufacture high-quality cigarettes or filter cigarettes and also improving the productivity.

Specifically, the compression molding apparatus may further include a compression pulley associated with the compression belt. The compression pulley defines the terminal end of the compression belt and has an annular groove on an outer peripheral surface thereof for receiving the compression belt in an arcuately curved state. The extension of the tobacco band has a return portion situated on a downstream side of the compression belt. The return portion is guided by the annular groove of the compression pulley while being kept in a curved state, and after passing the compression pulley, returns to a band roller for the tobacco band. The compression pulley is rotated synchronously with the band roller, and as the compression pulley rotates, the compression belt is pulled from the band roller toward the compression pulley.

As stated above, the compression belt and the tobacco band form a one-piece member, and thus no special member serving only as the compression belt is required. Also, since the compression belt travels synchronously with the tobacco band, the tobacco stream is transferred smoothly from the tobacco band to the compression belt.

The compression molding apparatus may further comprise stabilizing means for stabilizing the travel of the tobacco band and its extension. The stabilizing means includes a tension pulley rotatably arranged between the compression pulley and the band roller, and the tension pulley pushes the return portion of the extension toward the compression pulley and the band roller. The tension pulley serves to apply a predetermined tensile force to the return portion, and at the same time to secure a sufficiently large angle of contact between the return portion and the compression pulley, thus enabling the compression belt to travel smoothly while being pulled by the compression pulley.

In addition to the tension pulley, the stabilizing means may further include a tension roller. The tension roller is arranged near the band roller on one side thereof opposite the compression pulley and is supported rotatably. Like the tension pulley, the tension roller serves to apply a predetermined tensile force to the tobacco band and also to secure a sufficiently large angle of contact between the tobacco band and the band roller. Consequently, the tobacco band can be pulled reliably by the band roller, whereby the travel of the tobacco band is stabilized.

The compression molding apparatus may further include flattening means for flattening the extension, that is, the return portion of the tobacco band. The flattening means reshapes the return portion, which is curved as it passes the compression pulley, into a flat state before the return portion reaches the band roller.

Specifically, the flattening means includes the tension pulley rotatably arranged between the compression pulley and the band roller, and the tension pulley has a flat outer peripheral surface pressed against the return portion. The tension pulley applies a predetermined tensile force to the return portion and at the same time reshapes, with its outer peripheral surface, the curved return portion into a flat state. Consequently, the return portion, that is, the tobacco band, can be brought into close contact with the band roller, whereby the travel of the tobacco band is stabilized.

The flattening means may further include a flattening guide, in addition to the tension pulley. The flattening guide is a fixed member arranged between the tension pulley and the band roller. After passing the tension pulley, the return portion comes into sliding contact with the flattening guide, and this sliding contact prevents the return portion from becoming curved again from the flat state.

The compression molding apparatus may further include a molding guide contiguous with the compression pulley on an immediately downstream side thereof in the direction of conveyance of the tobacco stream, and the molding guide defines an extended portion of the compression molding passage.

Specifically, the molding guide includes a guide groove extending from the compression pulley and having an arcuate cross-sectional form. The arc of the guide groove at one end thereof contiguous with the compression pulley has a radius of curvature equal to that of the annular groove of the compression pulley. Consequently, the tobacco stream is smoothly introduced into the guide groove of the molding guide after passing through the compression molding passage.

Further, the molding guide has a scraper edge at one end thereof contiguous with the compression pulley. The scraper edge peels the tobacco stream from the terminal end of the compression belt, thus permitting the tobacco stream to be introduced into the guide groove of the molding guide without fail.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not limitative of the present invention, wherein.

BEST MODE OF CARRYING OUT THE INVENTION

Figure 1:
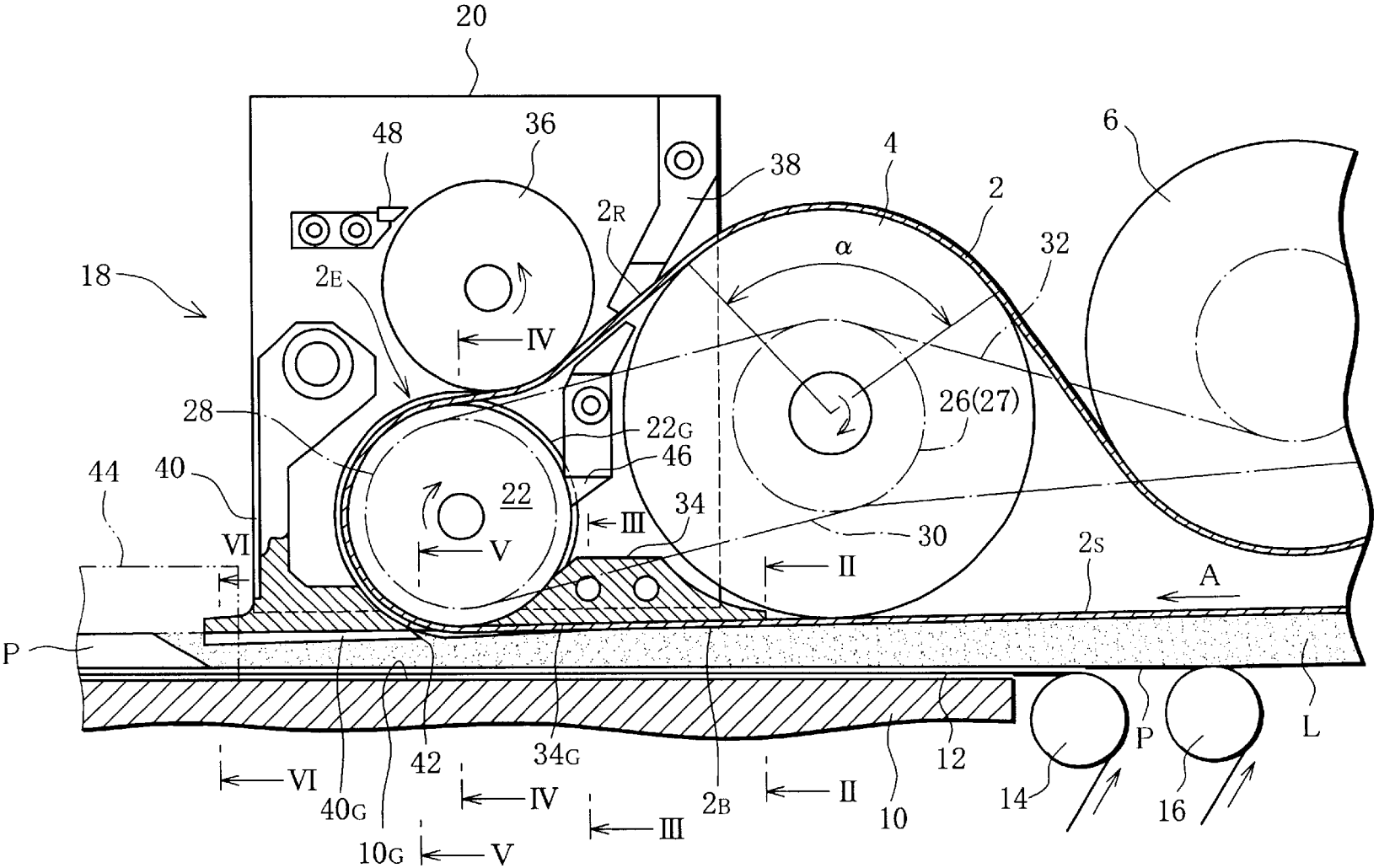
FIG. 1 is a longitudinal sectional view of a belt-type compression molding apparatus applied to a cigarette manufacturing machine.

Referring to FIG. 1, a cigarette manufacturing machine has an endless tobacco band 2. The tobacco band 2 is made of cloth of synthetic fibers and has flexibility and porosity. The tobacco band 2 extends between a driving roller 4 as a band roller and a driven roller (not shown), and is applied with a predetermined tensile force by a tension roller 6. The tension roller 6 is arranged near the driving roller 4, and this side-by-side arrangement serves to secure a sufficiently large angle $\alpha$ of contact between the driving roller 4 and the tobacco band 2.

The tobacco band 2 has a lower band portion traveling from the driven roller to the driving roller 4, and the lower band portion is defined as a suction belt $\mathbf{2}_S$ which is supplied with suction. The suction belt $\mathbf{2}_S$ retains a layer of shredded tobacco by suction on a lower surface thereof, thus forming a tobacco stream L, and as the tobacco band 2 travels, the tobacco stream L is conveyed in the direction of arrow A in FIG. 1. The shredded tobacco is blown up within a chimney (not shown), which is arranged below the suction belt $\mathbf{2}_S$, toward the suction belt $\mathbf{2}_S$.

The cigarette manufacturing machine further includes a molding bed 10. The molding bed 10 extends from a location below the driving roller 4 in the direction A of conveyance of the tobacco stream L. The molding bed 10 has a molding groove $\mathbf{10}_G$ (see FIGS. 3 to 6) on an upper surface thereof, and the molding groove $\mathbf{10}_G$ guides an endless garniture tape 12. The garniture tape 12 extends horizontally between front and rear guide rollers 14 arranged near respective opposite ends of the molding bed 10. FIG. 1 shows only the rear guide roller 14. The garniture tape 12 is also passed round a driving drum (not shown) located below the molding bed 10. As the driving drum rotates, the garniture tape 12 travels in the same direction as the conveying direction A of the tobacco stream L. The traveling speed of the garniture tape 12 is equal to the conveying speed of the tobacco stream L.

The garniture tape 12 is fed with wrapping paper P on an upper surface thereof. The wrapping paper is supplied from a web roll (not shown) arranged below the molding bed 10, and is guided onto the garniture tape 12 via a guide roller 16.

The molding groove $\mathbf{10}_G$ of the molding bed 10 emerges at a location below the driving roller 4 and extends in the conveying direction A of the tobacco stream L. More specifically, the molding groove $\mathbf{10}_G$ has a bottom thereof curved in a manner such that the radius of curvature gradually decreases from the starting end to the terminal end of the molding groove and that the bottom of the molding groove $\mathbf{10}_G$ is nearly semicircular in cross section at the terminal end. Consequently, as the garniture tape 12 advances in the molding groove $\mathbf{10}_G$, it is bent into a shape matching that of the molding groove and is finally curved into a U-shape as viewed in cross section. In this case, since the wrapping paper P on the garniture tape 12 travels together with the tape 12, the wrapping paper P also is similarly bent with the garniture tape 12.

A compression molding apparatus 18 is arranged right above the molding bed 10 on an immediately downstream side of the driving roller 4. The compression molding apparatus 18 has a mounting plate 20 extending vertically on either side of the molding bed 10. The mounting plate 20 has a compression pulley 22 at a lower portion thereof, and the compression pulley 22 is rotatably supported on the mounting plate 20.

As clearly shown in FIG. 1, the tobacco band 2 has an extended portion or extension $\mathbf{2}_E$ extending from the driving roller 4 into the compression molding apparatus 18, and the extension $\mathbf{2}_E$ passes around the compression pulley 22 and then returns to the driving roller 4.

The extension $\mathbf{2}_E$ of the tobacco band 2 has a portion located between the driving roller 4 and the compression pulley 22 and extending straight from the suction belt $\mathbf{2}_S$ continuously therewith, and this portion serves as a compression belt $\mathbf{2}_B$.

Timing belt pulleys 26 and 28 are respectively mounted on the shafts of the driving roller 4 and the compression pulley 22 and are connected to each other by a timing belt 30. Another timing belt pulley 27, which is separate from the timing belt pulley 26, is mounted on the shaft of the driving roller 4, and as a timing belt 32 travels, the timing belt pulley 27, that is, the driving roller 4, is rotated in one direction. Accordingly, as the driving roller 4 is rotated, the compression pulley 22 also is rotated synchronously, with the result that the compression belt $\mathbf{2}_B$ travels from the driving roller 4 to the compression pulley 22 synchronously with the suction belt $\mathbf{2}_S$ at the same speed.

The compression molding apparatus 18 has a guide support 34 located between the driving roller 4 and the compression pulley 22 and securely fixed to the mounting plate 20. The guide support 34 extends from a location just past the starting end of the compression belt $\mathbf{2}_B$ (i.e., just past the point of contact between the driving roller 4 and the suction belt $\mathbf{2}_S$) up to a location just short of the terminal end of the compression belt $\mathbf{2}_B$ (i.e., just short of the point of contact between the compression pulley 22 and the compression belt $\mathbf{2}_B$). Thus, the guide support 34 serves to support the back or internal side of the compression belt $\mathbf{2}_B$ with its lower surface over a distance from the driving roller 4 to the compression pulley 22 and also to guide travel of the compression belt $\mathbf{2}_B$.

The lower surface of the guide support 34 is flat at one end thereof close to the starting end of the compression belt $\mathbf{2}_B$ but is in the form of a downwardly curved arc, as viewed in cross section, at the other end thereof close to the terminal end of the compression belt $\mathbf{2}_B$. More specifically, the lower surface of the guide support 34 is curved such that the radius of curvature gradually decreases from the one end toward the other end. In other words, the lower surface of the guide support 34 has a guide groove $\mathbf{34}_G$ (see FIGS. 3 and 4) therein which gradually develops from the one end toward the other.

Also, the compression pulley 22 has an annular groove $\mathbf{22}_G$ at its outer periphery, and the annular groove $\mathbf{22}_G$ has an arcuate cross-sectional form. The annular groove $\mathbf{22}_G$ has a radius of curvature substantially equal to that of the guide groove $\mathbf{34}_G$ at the other end of the guide support 34. Accordingly, as the compression belt $\mathbf{2}_B$ travels from the driving roller 4 toward the compression pulley 22, the compression belt $\mathbf{2}_B$ is gradually bent into a downwardly curved form matching the shape of the guide groove $\mathbf{34}_G$ and then enters the annular groove $\mathbf{22}_G$ of the compression pulley 22. The compression belt $\mathbf{2}_B$ defines a compression molding passage in cooperation with the aforementioned molding groove $\mathbf{10}_G$ of the molding bed 10. Further, the other end face of the guide support 34 is concaved so as to extend along the annular groove $\mathbf{22}_G$ of the compression pulley 22. This concaved end face of the guide support 34 is preferably convexed, as viewed in cross section along a radius direction of the compression pulley 22, so as to match the annular groove $\mathbf{22}_G$.

The compression molding apparatus 18 further includes a tension pulley 36. The tension pulley 36 is located immediately above the compression pulley 22 and rotatably supported on the mounting plate 20. The tension pulley 36 serves to apply a predetermined tension to the extension $\mathbf{2}_E$ of the tobacco band 2, that is, to a return portion $\mathbf{2}_R$ of the extension $\mathbf{2}_E$ extending from the compression pulley 22 to the driving roller 4, and at the same time to ensure stable winding of the return portion $\mathbf{2}_R$ round the compression pulley 22. The tension pulley 36 has a flat outer peripheral surface, and therefore, the return portion $\mathbf{2}_R$, which is in a curved state just after leaving the annular groove $\mathbf{22}_G$ of the compression pulley 22, is flattened by the outer peripheral surface of the tension pulley 36 and then guided to the driving roller 4. The mounting plate 20 may further include a flattening guide 38, in order for the return portion $\mathbf{2}_R$ to be flattened without fail before the return portion $\mathbf{2}_R$ reaches the driving roller 4. The flattening guide 38 is fixed at a location between the tension pulley 36 and the driving roller 4. The flattening guide 38 pushes down the external side of the return portion $\mathbf{2}_R$ when the extension $\mathbf{2}_E$ passes thereby, to prevent the return portion $\mathbf{2}_R$, which has been flattened by the tension pulley 36, from becoming curved again.

The compression molding apparatus 18 further includes a molding guide, that is, a short tongue 40. The short tongue 40 is arranged on an immediately downstream side of the compression pulley 22 in the direction A of conveyance of the tobacco stream L, and is fixed to the mounting plate 20. The short tongue 40 has a guide groove $\mathbf{40}_G$ formed in a lower surface thereof. The guide groove $\mathbf{40}_G$ is positioned in alignment with the guide groove $\mathbf{34}_G$ of the guide support 34 and extends straight from the annular groove $\mathbf{22}_G$ of the compression pulley 22. The guide groove $\mathbf{40}_G$ has a downwardly arcuated form in cross section. The bottom of the guide groove $\mathbf{40}_G$ is curved in a manner such that the radius of curvature gradually decreases from one end of the guide groove $\mathbf{40}_G$ close to the compression pulley 22 to the other end thereof. More specifically, the radius of curvature of the bottom of the guide groove $\mathbf{40}_G$ at the one end thereof is equal to that of the annular groove $\mathbf{22}_G$ of the compression pulley 22, and the other end of the guide groove $\mathbf{40}_G$ is nearly semicircular in cross section.

The guide groove $\mathbf{40}_G$ defines, in cooperation with the molding groove $\mathbf{10}_G$ of the molding bed 10, a passage which is continuous with the aforementioned compression molding passage and constitutes an extended portion thereof. Further, the end face of the short tongue 40 close to the compression pulley 22 is concaved so as to extend along the compression pulley 22. Since the short tongue is thus concaved, a scraper edge 42 is formed at the corresponding end of the guide groove $\mathbf{40}_G$, and this scraper edge 42 serves to peel the tobacco stream L from the compression belt $\mathbf{2}_B$ and to smoothly guide the stream into the extended portion of the compression molding passage. Preferably, the concaved end face of the short tongue 40 is also convexed, as viewed in cross section along a radius direction of the compression pulley 22, so as to match the annular groove $\mathbf{22}_G$ of the compression pulley 22.

The cigarette manufacturing machine has a wrapping section, that is, a wrapping paper mold 44, arranged on a downstream side of the compression molding apparatus 18, as known in the technical field concerned, and the wrapping paper mold 44 includes an upstream-side short holder and a downstream-side long holder. As the U-shaped wrapping paper P is supplied together with the tobacco stream L from the compression molding apparatus 18, the short and long holders successively bend both edge portions of the wrapping paper P over the round-shaped tobacco stream L to be overlapped one upon the other. As a result, the tobacco stream L is completely wrapped in the wrapping paper P. One edge of the wrapping paper P is applied with paste before it is lapped over the other edge of the paper.

Operation of the above compression molding apparatus 18 will be now described in detail.

Figure 2:
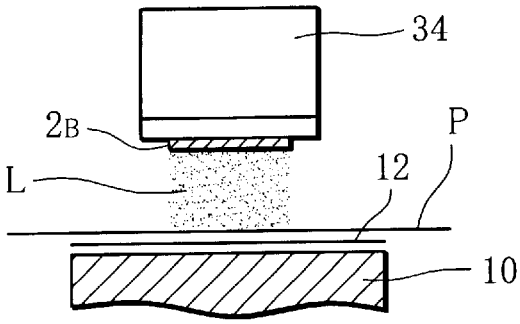
FIG. 2 is a cross-sectional view taken along line II—II in FIG. 1.

The tobacco stream L is conveyed with the suction belt $\mathbf{2}_S$, and after reaching the inlet of the compression molding passage, it is continuously conveyed thereafter by the compression belt $\mathbf{2}_B$ and the wrapping paper P, as shown in FIG. 2. As the compression belt $\mathbf{2}_B$ advances in the compression molding passage, it is bent in conformity with the shape of the guide groove $\mathbf{34}_G$ of the guide support 34 gradually from a flat state to a downwardly curved state, both as viewed in cross section. On the other hand, as the wrapping paper P advances in the compression molding passage, it also is gradually bent together with the garniture tape 12 into a U-shape conforming to the shape of the molding groove $\mathbf{10}_G$ of the molding bed 10.

Figure 3:
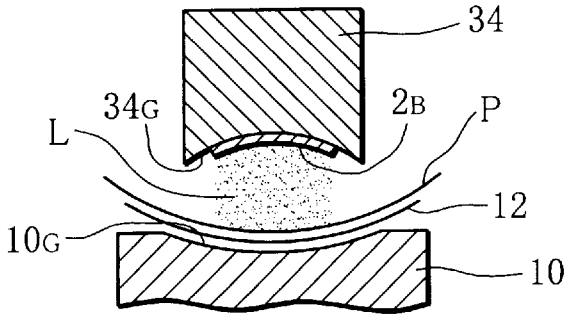
FIG. 3 is a cross-sectional view taken along line III—III in FIG. 1.

As a result, the lower half of the tobacco stream L is gradually wrapped in the wrapping paper P from below, and at the same time, the upper half of the tobacco stream L is also gradually wrapped in the compression belt $\mathbf{2}_B$, as shown in FIG. 3. The front portion of the compression molding passage has a cross-sectional area gradually decreasing with advance of the tobacco stream L, as is clear from the foregoing description. Accordingly, the upper half of the tobacco stream L is compressed from above while being wrapped in the compression belt 2B, and simultaneously, the lower half of the tobacco stream is also compressed from below while being wrapped in the wrapping paper P. As a result, the tobacco stream L is constricted from above and below into arcuate shape.

The compression belt $\mathbf{2}_B$ travels at the same speed as the tobacco stream L and also maintains the suction force like the suction belt $\mathbf{2}_S$. Thus, even if the tobacco stream L enters the compression molding passage at high speed, the compression belt $\mathbf{2}_B$ never constitutes resistance to the conveyance of the tobacco stream L and instead serves to maintain the high-speed conveyance of the tobacco stream L. Accordingly, the compression belt $\mathbf{2}_B$ can smoothly constrict the tobacco stream L, whereby the shredded tobacco in the tobacco stream L is prevented from being overheated due to heat produced by friction between the compression belt $\mathbf{2}_B$ and the tobacco stream L and also fragmentation of the shredded tobacco is lessened.

The wrapping paper P also travels at the same speed as the tobacco stream L, and thus it never overheats or fragments the shredded tobacco in the tobacco stream L.

Figure 4:
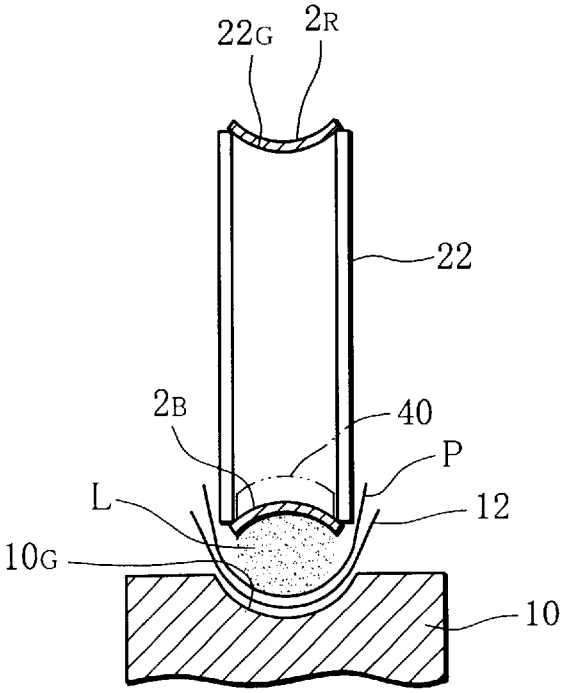
FIG. 4 is a cross-sectional view taken along line IV—IV in FIG. 1.
Figure 5:
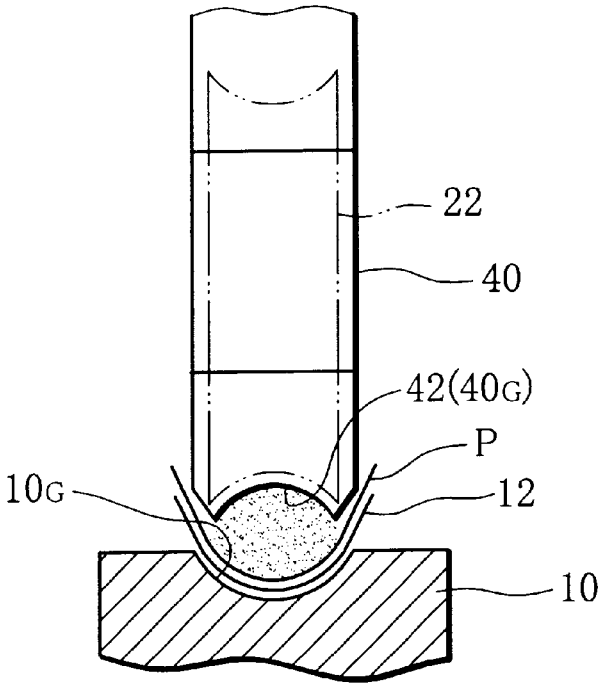
FIG. 5 is a cross-sectional view taken along line V—V in FIG. 1.

When the tobacco stream L reaches the terminal end of the compression belt $\mathbf{2}_B$, that is, the compression pulley 22, the tobacco stream L is in a state such that it is further constricted from above and below, as shown in FIG. 4. On passing by the compression pulley 22, the tobacco stream L is peeled from the compression belt $\mathbf{2}_B$ by the scraper edge 42 (see FIG. 5) of the short tongue 40 and is then introduced into the extended portion of the compression molding passage.

As stated above, the radius of curvature of the guide groove $\mathbf{40}_G$ of the short tongue 40 at the one end thereof is equal to that of the compression belt $\mathbf{2}_B$ at the terminal end thereof, so that the extended portion of the compression molding passage smoothly connects with the compression molding passage. Consequently, the tobacco stream L peeled from the compression belt $\mathbf{2}_B$ is smoothly introduced into the extended portion of the compression molding passage, and the boundary between the compression pulley 22 and the short tongue 40 never constitutes large resistance to the conveyance of the tobacco stream L.

Figure 6:
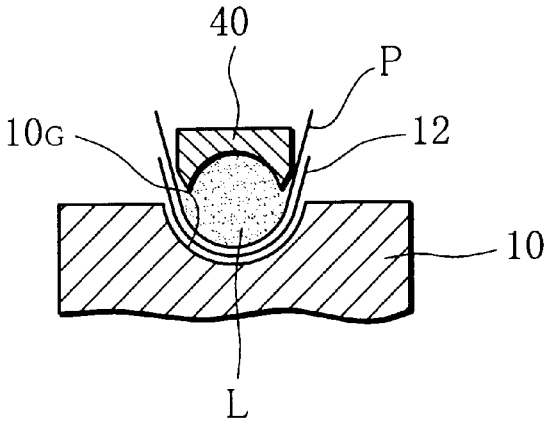
FIG. 6 is a cross-sectional view taken along line VI—VI in FIG. 1.

As the tobacco stream L advances, the short tongue 40 further constricts the tobacco stream L. At the terminal end of the extended portion of the compression molding passage, therefore, the tobacco stream L is compression molded into a nearly cylindrical shape, as shown in FIG. 6, and its shape is stabilized by the short tongue 40 in cooperation with the molding groove $\mathbf{10}_G$ of the molding bed 10.

The short tongue 40 is a fixed member, unlike the compression belt $\mathbf{2}_B$, but does not constitute large resistance to the conveyance of the tobacco stream L. Namely, since the compression molding of the tobacco stream L is almost completed within the compression molding passage by means of the compression belt $\mathbf{2}_B$, the tobacco stream L may be constricted only a little inside the short tongue 40 and thus the short tongue 40 scarcely overheats or fragments the shredded tobacco in the tobacco stream L.

After leaving the short tongue 40, the tobacco stream L thus compression molded is finally completely wrapped in the wrapping paper P by the aforementioned wrapping paper mold 44 in the manner conventionally known, and as a result, a tobacco rod is continuously formed.

The tobacco rod is thereafter successively passed through a drier and a cutter of the cigarette manufacturing machine. The drier dries the pasted portion of the wrapping paper P of the tobacco rod, that is, the seam of the tobacco rod. The cutter, on the other hand, cuts the tobacco rod into individual cigarettes of predetermined length.

With the compression molding apparatus 18 described above, even if the speed of conveyance of the tobacco stream L is increased, overheating and fragmentation of the shredded tobacco in the tobacco stream L can be effectively prevented without fail. Accordingly, the shredded tobacco in the tobacco rod does not suffer heat deterioration and the original smoking taste can be maintained. The compression molding apparatus therefore greatly contributes to the improvement of productivity of smoking products such as cigarettes and filter cigarettes made therefrom, while at the same time maintains high quality of the smoking products.

Even if the tobacco stream L is made to pass at high speed through the compression molding apparatus 18, fragmentation of the shredded tobacco in the tobacco stream L can be kept at a low level as mentioned above, and thus no soft spots are produced in the tobacco rod due to fragmentation of the shredded tobacco. It is therefore possible to prevent without fail the shredded tobacco from dropping from a cut end at or after the cutting of the tobacco rod or cigarettes. This contributes immensely to the maintenance of high quality of the smoking products.

Stable travel of the compression belt $\mathbf{2}_B$ is essential to the aforementioned compression molding of the tobacco stream L. Preferably, therefore, the compression pulley 22 and the tension pulley 36 are provided respectively with cleaning scrapers 46 and 48, as shown in FIG. 1. The cleaning scrapers 46 and 48 serve to remove the shredded tobacco adhering to the annular groove $\mathbf{22}_G$ of the compression pulley 22 and the outer peripheral surface of the tension pulley 36, respectively.

The compression molding of the tobacco stream L by means of the short tongue 40 is not essential to the present invention. Instead of the short tongue 40, a molding guide simply shaped like a tunnel may be used. In this case, the molding guide defines, in cooperation with the molding groove lOG of the molding bed 10, a guide passage connecting between the compression pulley 22 and the wrapping paper mold 44, and the compression molded tobacco stream L is guided, together with the wrapping paper P, into the wrapping paper mold 44 through the guide passage.

It is to be understood that the present invention is not limited to the embodiment described above, and that various changes and modifications may be effected therein by one skilled in the art without departing from the scope or spirit of the invention.

What is claimed is:

1. A compression molding apparatus for a tobacco stream, the tobacco stream being formed by being drawn by suction onto a flat, endless tobacco band inside a cigarette manufacturing machine and conveyed toward a wrapping section of the cigarette manufacturing machine as the tobacco band travels, the tobacco band being guided by and passed round a band roller on a wrapping section side, said compression molding apparatus comprising:

a compression belt formed by part of an extension of the tobacco band extended from the band roller toward the wrapping section, said compression belt defining a compression molding passage for the tobacco stream on one side thereof; and a guide support for supporting an opposite side of said compression belt over an entire area of the compression molding passage, said guide support including a guide groove for guiding travel of said compression belt, the guide groove causing said compression belt to be curved in a manner such that a cross-sectional form of said compression belt gradually changes from a flat shape at an inlet of the compression molding passage to an arcuate shape at an outlet of same.

2. The compression molding apparatus according to claim 1, further comprising a rotatable compression pulley defining a terminal end of the compression belt, said compression pulley having an annular groove on an outer peripheral surface thereof for receiving the compression belt in a curved state, the extension of the tobacco band having a return portion which is guided by the annular groove of the compression pulley while being kept in a curved state and which returns to the band roller after passing the compression pulley.

3. The compression molding apparatus according to claim 2, wherein said compression pulley is rotated synchronously with the band roller.

4. The compression molding apparatus according to claim 2, further comprising stabilizing means for stabilizing travel of the tobacco band and the extension thereof.

5. The compression molding apparatus according to claim 4, wherein said stabilizing means includes a tension pulley rotatably arranged between the compression pulley and the band roller, said tension pulley pushing the return portion toward the compression pulley and the band roller.

6. The compression molding apparatus according to claim 5, wherein said stabilizing means includes a tension roller rotatably arranged near the band roller on one side thereof opposite the compression pulley, said tension roller applying a predetermined tensile force to the tobacco band and also providing a predetermined angle of contact between the tobacco band and the band roller.

7. The compression molding apparatus according to claim 2, further comprising a molding guide contiguous with the compression pulley on an immediately downstream side thereof in a direction of conveyance of the tobacco stream, said molding guide defining an extended portion of the compression molding passage.

8. The compression molding apparatus according to claim 7, wherein said molding guide includes a guide groove extending from the compression pulley and having an arcuate cross-sectional form, an arc of the guide groove at one end thereof contiguous with the compression pulley having a radius of curvature equal to that of the annular groove of the compression pulley.

9. The compression molding apparatus according to claim 8, wherein said molding guide further includes a scraper edge at one end thereof contiguous with the compression pulley, said scraper edge peeling the tobacco stream from the terminal end of the compression belt.

10. The compression molding apparatus according to claim 3, further comprising flattening means for flattening the return portion, said flattening means reshaping the return portion, which is curved as the return portion passes the compression pulley, into a flat state before the return portion reaches the band roller.

11. The compression molding apparatus according to claim 10, wherein said flattening means includes a tension pulley rotatably arranged between the compression pulley and the band roller, said tension pulley having a flat outer peripheral surface pressed against the return portion.

12. The compression molding apparatus according to claim 11, wherein said flattening means further includes a flattening guide arranged between the tension pulley and the band roller, said flattening guide being disposed in relative sliding contact with the return portion.

13. The compression molding apparatus according to claim 4 or 5, wherein said stabilizing means includes a tension roller rotatably arranged near the band roller on one side thereof opposite the compression pulley, said tension roller applying a predetermined tensile force to the tobacco band and also providing a predetermined angle of contact between the tobacco band and the band roller.

* * * * *